US005779170A

United States Patent [19]

Siepmann et al.

[11] Patent Number: 5,779,170

[45] Date of Patent: Jul. 14, 1998

[54] METHOD AND APPARATUS FOR REPLACING FULL PACKAGES WITH EMPTY TUBES ON A TAKEUP MACHINE FOR A CONTINUOUSLY ADVANCING YARN

[75] Inventors: Peter Siepmann, Schwelm; Hermann Westrich, Wuppertal; Jurgen Gsell, Wuppertal; Wolfgang Fink, Wuppertal, all of Germany

[73] Assignee: Barmag AG, Remscheid, Germany

[21] Appl. No.: 727,534

[22] PCT Filed: Feb. 23, 1996

[86] PCT No.: PCT/DE96/00285

§ 371 Date: Feb. 11, 1997

§ 102(e) Date: Feb. 11, 1997

[87] PCT Pub. No.: WO96/26150

PCT Pub. Date: Aug. 29, 1996

[30] Foreign Application Priority Data

| | | | |
|---|---|---|---|
| Feb. 24, 1995 | [DE] | Germany | 195 06 468.2 |
| Jul. 22, 1995 | [DE] | Germany | 195 26 904.7 |
| Jul. 29, 1995 | [DE] | Germany | 195 27 920.4 |

[51] Int. Cl.[6] ..... B65H 54/02

[52] U.S. Cl. ..... 242/35.5 A; 242/18 A; 242/18 R; 242/35.5 T; 242/534

[58] Field of Search ..... 242/35.5 A, 35.5 T, 242/36, 18 A, 18 R, 533.5, 534

[56] References Cited

U.S. PATENT DOCUMENTS

| | | | |
|---|---|---|---|
| 3,921,922 | 11/1975 | Wust | 242/18 A |
| 4,023,743 | 5/1977 | Schippers | 242/18 A |
| 4,340,187 | 7/1982 | Schippers et al. | 252/35.5 A |
| 4,441,660 | 4/1984 | Cloud et al. | 242/35.5 A |
| 5,029,762 | 7/1991 | Behrens et al. | 242/18 A |
| 5,393,003 | 2/1995 | Watermann | 242/35.5 A |
| 5,526,995 | 6/1996 | Westrich et al. | 242/35.5 A |
| 5,568,720 | 10/1996 | Teich et al. | 242/18 A |

FOREIGN PATENT DOCUMENTS

| | | |
|---|---|---|
| 0 025 128 | 3/1981 | European Pat. Off. . |
| 1 463 222 | 2/1977 | United Kingdom . |
| WO 93/17949 | 9/1993 | WIPO . |

OTHER PUBLICATIONS

Barmag AG, Aut 14(d), *Doffer WD5*, 4 pages.

Barmag AG, Aut 15(d), *Doffer WD9*, 2 pages.

*Primary Examiner*—William Stryjewski

*Attorney, Agent, or Firm*—Bell Seltzer Intellectual Property Law Group of Alston & Bird LLP

[57] ABSTRACT

A takeup machine for continuously advancing yarns (1) comprises a spindle revolver (5) mounting two winding spindles (6, 7), which alternate in winding packages (10). The packages are doffed by a servicing automat (doffer) in two positions of the spindle revolver (5) which is moved on step-by-step as the package increases in size on the operating spindle (6). The two positions for removing the full package or packages and for slipping an empty tube or tubes (8, 9) on the previously emptied idle spindle (7) may be located at any desired points within a doffing range (41), since the package mandrels of the servicing automat are caused to follow the idle spindle (7) by suitable sensors.

21 Claims, 5 Drawing Sheets

METHOD AND APPARATUS FOR REPLACING FULL PACKAGES WITH EMPTY TUBES ON A TAKEUP MACHINE FOR A CONTINUOUSLY ADVANCING YARN

BACKGROUND OF THE INVENTION

The present invention relates to a yarn winding method and apparatus of the type having a rotatable turret or revolver which mounts a pair of winding spindles, and wherein the winding spindles are alternately moved between a winding range and a doffing range as the revolver is sequentially rotated.

Such a method and an apparatus for carrying out the method are known from WO 93/17949 and corresponding U.S. Pat. No. 5,526,995. The known apparatus comprises a spindle revolver mounting two winding spindles, which are moved by the rotation of the spindle revolver alternately to a winding range and to a doffing range. In the doffing range, the full packages are pushed off, on the one hand, and subsequently empty tubes are slipped onto the emptied winding spindle.

Furthermore, for a clear distinction between the two winding spindles, the winding spindle being in the winding range is described as the operating spindle, and the winding spindle being in the doffing range is referred to as the idle spindle.

In a winding machine as known from EP 0 374 536B and corresponding U.S. Pat. No. 5,029,762, the full packages are removed from the idle spindle at the end of a winding cycle, and exchanged for empty tubes, since the yarn advances thereto continuously. To perform the package doff, the takeup machine is equipped with a servicing automat or doffer, such as is known, for example, from the Barmag AG Brochures Aut 14(d) "Doffer WD 5" or Aut 15(d) "Doffer WD9". Such a servicing automat is provided with a package mandrel for receiving the finished spinning packages from the idle spindle, and a second mandrel for supplying the emptied winding spindle with new empty tubes.

Since the winding spindles are arranged relatively close together as a result of the compact construction of such takeup machines, and since at the now common high takeup speeds, the winding packages on the operating spindle enlarge very quickly toward the non-doffed packages at the doffing range, the package doffs must follow each other very quickly. This is particularly true when winding yarns of more coarse denier, such as carpet yarn.

In the known winding machine as described in U.S. Pat. No. 5,029,762, the surface of the package being formed is engaged by a contact roll, which is mounted for limited movement in a radial direction away from the spindle upon which the package is mounted, and a sensor is provided for sensing such movement and rotating the revolver by means of a stepping motor so as to move the package along the winding range. This, again, results in that the full package on the idle spindle is further rotated, even during the doffing operation and, thus, moves out of alignment with the axis of the package mandrel that is arranged on the doffer for receiving the full packages.

Accordingly, only a limited parking time is available for the package doff, whereas the removal of the full packages and the replacement of the empty tubes takes a minimum doffing time. In this connection, it is necessary to observe that the package mandrel provided on the doffer for receiving the full packages and the mandrel for slipping on the empty tubes be in alignment with the winding spindle during the package doff.

In the takeup machine described in the aforesaid publication WO 93/17949, the object of providing an adequate time for exchanging the full packages for empty tubes despite the small spacing between winding spindles, is achieved by a method, which provides in the doffing range for two defined stopping positions and for a package doff in two stages. Such an operation is a considerable improvement over the previously known method. The lengthening of the doffing times, thus, lessens the problems with doffing packages during a continuous winding of synthetic filament yarns with textile and industrial filament deniers.

It is therefore the object of the invention to further develop the method of doffing packages such that the package doff occurs no longer in accordance with a rigid flow pattern, but is made more flexible with a doffing time that is adapted to the yarn being wound, so that the servicing automat (doffer) handling the package doff is stopped at the takeup station only as short a time as possible.

SUMMARY OF THE INVENTION

The above and other objects and advantages of the present invention are achieved by the provision of a yarn winding method and apparatus wherein doffing the full package from its spindle is effected while the spindle is in the doffing range. For this purpose, a package receiving mandrel is positioned in general axial alignment with the spindle, and the position of the spindle is monitored to detect any change of position thereof resulting from the continued rotation of the revolver during the build of the package on the other spindle which is in the winding range. The package receiving mandrel is moved so as to follow any detected movement of the spindle containing the full package, and maintain the axial alignment of the spindle and the packing receiving mandrel, and the full package is then axially displaced from the spindle onto the package receiving mandrel.

The method in accordance with the invention permits for the package doff an allowance for an adaptation between the individual winding heads and the doffer performing the package exchange, so that the servicing automat is stopped at a particular takeup station no longer than absolutely necessary. The sequence of the package doff is now defined by the machine control or doffer control system, and is dependent on the parameters, including the denier of the yarn being processed, the intended winding speed, the dimensions of the individual winding heads and the produced packages, and the gauges of the winding heads. The package doff is initiated as a function of the availability of the doffer at the takeup station which signals a package doff.

For determining the doffing range, it is necessary to take into account such factors as the possible takeup speeds, the dimensions of the individual winding heads, as well as of the produced packages and winding head gauges, and likewise the particular yarn deniers. The beginning of the doffing range is determined in that the idle spindle reaches its doffing position at the earliest, when the operating spindle has moved to its winding position at the beginning of a new winding cycle. However, if need arises, it may be advantageous to make a slight allowance for time which is usable for initiating the sequences of the motions.

It is therefore provided that the beginning of the doffing range follows the revolver position at the beginning of the winding operation at an angle of rotation of 180°. Taking into account the above-enumerated factors, the size of the doffing range should comprise an angle of rotation of at least 15° and at most 75°, preferably from 30° to 60°.

In the method of the present invention, monitoring and control devices of the winding spindle cause the servicing automat or its doffing equipment to follow in exact alignment, at least as soon as the winding spindle being doffed enters into in the doffing range. In accordance with the invention, the servicing automat or its doffing equipment may follow as a function of control signals of the particular winding head that are supplied to the machine control, or as a function of control signals of the servicing automat.

In one embodiment of the method in accordance with the invention, a package doff is signalled to a free servicing automat at a short time interval, before the spindle revolver rotates into the doffing range, so as to call the servicing automat to the particular winding head. After adjusting the package mandrel of the doffer, the finished packages are pushed from the winding spindle. Thereafter, the package mandrel of the servicing automat (doffer), which carries the empty tubes, is adjusted and caused to follow the idle spindle that has meanwhile moved on, until their axes are in alignment and the empty tubes can be slipped from the package mandrel of the doffer onto the emptied winding spindle.

An advantageous development of the method in accordance with the invention provides that the followup movement of the package mandrel of the doffer for its alignment with the idle spindle is effected by the machine control unit of the particular winding head. As a result of continuously detecting the position of the idle spindle to be doffed and of keeping the acquired position data ready, it is made possible, upon availability of the servicing automat (doffer), to bring and keep its package mandrel and, thereafter, its tube inserting device in an exact alignment with the idle spindle with the use of the acquired position data of the winding spindle that is to be doffed.

In accordance with the invention, the package doff may occur—depending on the particular circumstances, such as winding speed, yarn denier, package dimensions, and the like—without influencing the rotational drive of the spindle revolver during the package doff. To this end, the doffer is always held in a precise doffing position, while evaluating the changing position data of the further rotating idle spindle, i.e., its package mandrel for receiving the full packages follows the idle spindle. As a result, the package doff and the supply of empty tubes to the winding spindle occur without being rigidly defined in time, as soon as a servicing automat is available for this purpose. In the case of a plurality of takeup machines and servicing automats, investment costs may be saved, since possibly a lesser number of servicing automats is needed.

The fact that at least within the doffing range, the package mandrel of the servicing automat (doffer) follows the movement of the winding spindle being doffed and is held in the axial extension thereof, provides the possibility of initiating the operation of transferring the empty tubes at any desired position within the doffing range.

In accordance with the invention, a following or tracking device consists of a sensor arrangement and a reflector arrangement cooperating therewith. While, in accordance with the invention, the sensor arrangement or the reflector arrangement may be provided on the winding head, in particular on the ends of the winding spindles of the winding head, and accordingly the sensor arrangement or the reflector arrangement may be provided on the end of the package mandrel, it is preferred to use normally a tracking device, in which the sensor arrangement is provided on the end of the package mandrel of the servicing automat (doffer) and the therewith cooperating reflector arrangement on the front end of each winding spindle, which faces the servicing automat.

In an advantageous embodiment of the tracking device in accordance with the invention, the package mandrel is designed and constructed as a supporting tube, and the sensor arrangement of the present invention is mounted on the front end of a mandrel insert, which is axially displaceable in the tubular package mandrel, and faces the winding spindle. This allows to accomplish that the package mandrel and the portion of the tracking device on the side of the doffer are movable independently of one another along the axis of the package mandrel. In such an embodiment, it is likewise possible to connect the sensor arrangement, via a signal line extending through an axial bore of the mandrel insert, to the doffer control unit, without influencing the movement of the package mandrel.

In an embodiment characterized substantially by mechanical means, the sensor arrangement comprises a position pin on the front surface of the package mandrel and an associated reflector arrangement, which is made concave and covers the free front end of the winding spindle. As regards the details thereof, reference may be made to the detailed description of the drawing.

To make the package mandrel on the doffer follow, the position pin is pushed, for example, by moving the mandrel insert forward, in direction toward the front end of the winding spindle carrying the full package, until a sensor head of the position pin comes into contact with the concave sensor surface. In this connection, the axial force acting upon the position pin is rated such that same is moved, if need be, while undergoing a deformation, along the sensor surface toward the deepest point thereof. A suitable evaluation device sees to it that the lateral deflections of the position pin are converted into control signals for having the package mandrel follow, until the position pin which is no longer deflected and has returned to its idle position, reaches the deepest point of the concave countersurface.

The position pin may be rigidly anchored in the front surface from which it extends, and it may be flexible, so that it can be deformed during the sensing movement. Alternatively, it may be flexibly anchored and deflected without deformation.

In a further embodiment, the sensor arrangement is a light source with a not too narrow light beam, which is aligned parallel to the opposite winding spindle. This light beam arrives at a reflector arrangement mounted on the front end of the winding spindle, when the package mandrel axis of the doffer is in alignment with the axis of the winding spindle. Preferably, the reflector arrangement is designed similar to a cat's eye, so that besides the main beam, also a scattering cone with a reduced light intensity is reflected. The sensor arrangement is provided with an evaluation circuit for the reflected light, which is intended to also cover the edges of the scattering cone. Preferably, the intensity of the reflected light may be evaluated by a detector in such a manner that the point of departure of the reflected light is determined in x–y coordinates, and that the measuring data corresponding to same are converted into signals for the follow-up movement of the package mandrel. These signals may be transmitted in like manner as the signals of the aforesaid arrangement, for example, via a signal line extending through an axial bore in the mandrel insert, to the machine control unit, in particular the doffer control unit.

In a preferred embodiment, the sensor arrangement is a device for measuring the distance which is equipped with a source of laser light. The beam of the laser that is directed to the front end of the winding spindle arrives there at a surface of a reflector arrangement, which is convexly or concavely curved in the direction of the beam. More details may be noted, also in this instance, from the description of the attached drawing.

Finally, in yet another embodiment of the invention, the sensor arrangement is an electromagnet, which is energized by alternating current, and builds up a magnetic a.c. field between the package mandrel or the mandrel insert and the front end of the opposite winding spindle. This electromagnet is installed in the center of the head of the package mandrel or mandrel insert, or preferably the winding spindle. The associated reflector arrangement consists of several, in particular four coils, which are short-circuited in themselves, and arranged on the front end of the opposite winding spindle, or preferably the opposite package mandrel, symmetrically to the axis thereof. An evaluation circuit for detecting and evaluating the voltages induced in the wire coils furnishes the control signals needed for the follow-up movement.

The frequency of the alternating current that energizes the electromagnet should be selected such as to obtain as clearly measurable differences as possible between the a.c. voltages that are induced in the individual coils, when the axes of the winding spindle and the a.c. field do not coincide, and until the axes coincide totally. Consequently, the frequency of the alternating current supplying the magnet is preferably variable, with frequencies between 10 Hz and 120 Hz, in particular between 25 Hz and 90 Hz having shown to be satisfactory.

In the takeup machine, in which the package mandrel of the servicing automat is made to follow by the machine control unit of the winding head, a sensor arrangement is integrated in the spindle revolver, which serves to continuously detect the rotor rotation and, thus, the varying positions of the winding spindle. Preferred is a magnetic field sensor arrangement. The magnet of this arrangement is stationarily connected to the spindle revolver, and rotates along with same, whereas the sensor element arranged in the magnetic field is stationarily anchored and, thus, prevented from rotating along.

In a preferred embodiment, the magnetic field sensor is inserted into a circular-cylindrical, cup-shaped recess in the spindle revolver. This recess is coaxial with the axis of rotation of the spindle revolver, and extends from the front side thereof which mounts the winding spindles.

Preferably, the magnet is a U-shaped permanent magnet, which is secured in the recess such that the magnetic poles extend in axial direction and parallel to the circular-cylindrical wall of the recess. Proceeding from this recess, a continuous axial bore extends through the rotor shaft, which accommodates a supporting device for the sensor elements. This supporting device may, for example, be a tubular carrier, which extends through the rotor bore in no contact therewith and is anchored on the machine frame.

While, as described in the following, one sensor element in the arrangement is adequate for tracking the idle spindle in the range of rotation of the spindle revolver, in which the package doff occurs, it may be accomplished that, when same is supplemented with a second sensor element rotated about the rotor axis by 90° relative to the first sensor element, the spindle positions can be tracked uninterrupted over 360°.

Each sensor element, for example, a small plate of a suitable semiconductor material, such as indium antimonide or indium arsenide, which is arranged in the field of the permanent magnet, must be connected to a source of direct current and, via supply lines and signal lines, to a device for detecting and evaluating the generated Hall voltage. In accordance with the invention, these lines may extend through the aforesaid, tubular supporting device for the sensor elements to a corresponding evaluation unit. The evaluation unit itself may be connected, via control lines, to the control unit of the doffer or its drive mechanisms.

Preferably, the magnetic field sensor is aligned with the winding spindles such that the magnetic field lines of the magnet rotating along with the spindle revolver extend vertically into the space in the zero position of the spindle revolver, i.e., in the position, which corresponds to the position that is reached when the operating spindle enters into the starting position of a winding cycle. When the sensor arrangement includes one sensor element, same is anchored, in the foregoing zero position of the spindle revolver, on the machine frame, with its axial extension being transverse to the field lines, and it is secured against rotation, so that its lateral surfaces facing the poles of the magnet intersect the field lines at an angle of 90°, when the axes of rotation of the two winding spindles extend vertically one on top of the other. However, it may be advantageous, in particular in the arrangement of only one sensor element, to align the magnetic field sensor with the winding spindles, so that the magnetic field lines of the magnet rotating along with the spindle revolver extend, in the aforesaid zero position of the spindle revolver, parallel to a plane drawn through the axes of the winding spindles. In this instance, it is necessary to anchor the sensor element accordingly on the machine frame, with its axial extension being transverse to the field lines, and to secure same against rotation such that, in the zero position of the spindle revolver, its lateral surfaces directed to the poles of the magnets intersect the aforesaid plane through the axes of the winding spindles at an angle of 90°. While the first-described arrangement, in particular when the sensor arrangement is provided with a second sensor element which is rotated by an angle of 90° relative to the first sensor element, with the rotor axis being the axis of rotation, is suitable for a continual tracking of the rotor rotation over 360°, the next-described arrangement with only one sensor element facilitates a very good tracking, in particular of the rotational movement of the idle spindle in the entire range of rotation of the spindle revolver that is useful for the package doff.

BRIEF DESCRIPTION OF THE DRAWINGS

The invention is described in more detail with reference to embodiments illustrated in the attached drawing, in which.

DETAILED DESCRIPTION OF THE PREFERRED EMBODIMENTS

Figure 1:
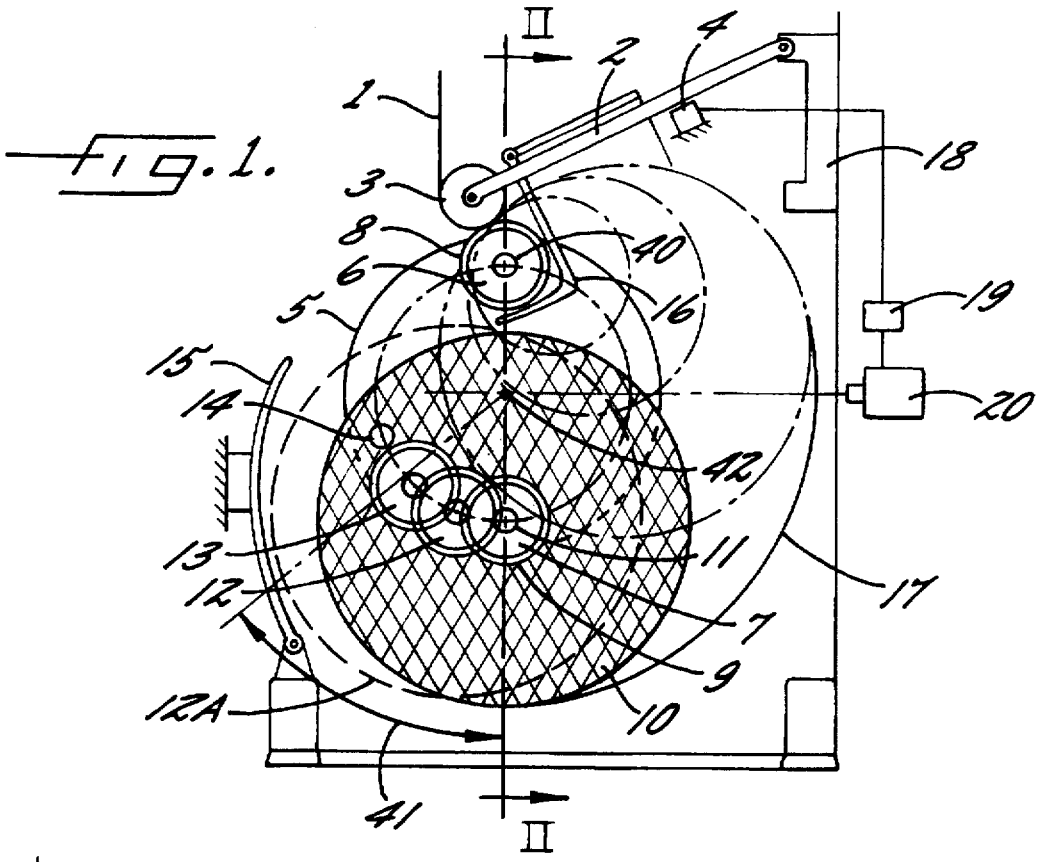
FIG. 1 is a front view and FIG. 2 is a side view of a takeup machine equipped with a first embodiment of the invention.

Shown in FIG. 1 is a front view of a takeup machine which is equipped in accordance with the invention with components known from the publication WO 93/17949. Arranged therein for rotation about its rotor axis 42 is a spindle revolver 5, which mounts two winding spindles 6, 7, each having a direct drive mechanism not shown. A rotational drive mechanism 20 of the spindle revolver is controlled by a sensor roll 3. The takeup machine is shown in its starting position 40 at the beginning of a new winding cycle. A full package 10 on idle spindle 7 has reached its doffing position within a doffing range 41, whereas the operating spindle 6 with an empty tube 8 thereon is in position 40 at the beginning of the winding cycle. The rotational drive mechanism 20 of spindle revolver 5 is a stepping motor. Same is controlled by a rotor control unit 19, which receives itself the stepping signals from a distance sensor 4. Same registers the movements of a rocker arm 2 which are dependent on the growth of the package on operating spindle 6, and converts same into switching signals.

A yarn 1 advancing from above is deflected by sensor roll 3, which is rotatably mounted on the free end of rocker arm 2 and rests against the empty tube 8, and is wound on tube 8. As the formation of a package continues on winding tube 8, the sensor roll 3 and the rocker arm 2 carrying same are raised, until upon reaching a predetermined limit distance, the distance sensor 4 supplies a switch signal to the revolver control unit 19, and the revolver 5 is further rotated.

A better illustration of the rapid growth of the diameter of forming package 10 during the winding of filaments and yarns with coarser deniers, in particular carpet yarn, and the thereby resultant further rotation of package 10, is shown FIG. 1 by circles drawn in dash-dotted lines. These circles are in contact with the sensor roll 3. They represent intermediate positions during this package formation and indicate at 12, 13, 14 corresponding positions of the idle spindle carrying package 10. Upon reaching the position 14, the winding cycle of operating spindle 6 is completed, and a further rotation of spindle revolver 5 initiates automatically a package doff.

Primarily, when winding carpet yarn, the indicated positions are reached, one after the other, relatively fast. Therefore, in comparison with the prior art, wherein two defined stopping positions are provided with a spacing shorter than that of the winding range, it may be useful to find other ways of coordinating chronologically the arrival at the stopping positions and the availability of a doffer. This all the more, since during a package doff, both a package mandrel 22 and a mandrel for empty tubes 8, 9 must be in alignment with the winding spindle 6, 7 during each transfer. In any event, in the present embodiment, as shown by the dash-dotted circle 12A indicating the position of full package 10 at spindle position 12, the doffer 21 must have already received the full package 10, when position 12 is reached, so as to prevent the full package 10 from colliding with a boundary plate 15 or a side wall between winding heads.

The aforesaid problems are avoided by the present invention, in that, as described, latest upon the entry of the idle spindle 7 into the doffing range 41, the position thereof relative to the package mandrel 22 of doffer 21 is detected. The mandrel is moved by means of the tracking device of the present invention to an alignment with the idle spindle 7 and guided such that it follows the movements of idle spindle 7, which are caused by the winding operation. The removal of full package 10 from idle spindle 7 occurs in general at the first stopping position in doffing range 41, i.e., at the time, when the full package 10 is rotated to the six-o'clock position.

The tracking device which consists in general of a sensor arrangement 24; 27; 29; 33 and a reflector arrangement 11; 25; 31; 34 cooperating therewith, may be realized in accordance with the invention in different embodiments. A reflector arrangement as used is understood to be a preferably passive device which cooperates with a mechanical, optical, electrical, electromagnetic, or other signalling device, and which reflects or returns the received signal, so that it can be analyzed and evaluated in an evaluation unit for controlling the doffer movements.

Figure 2:
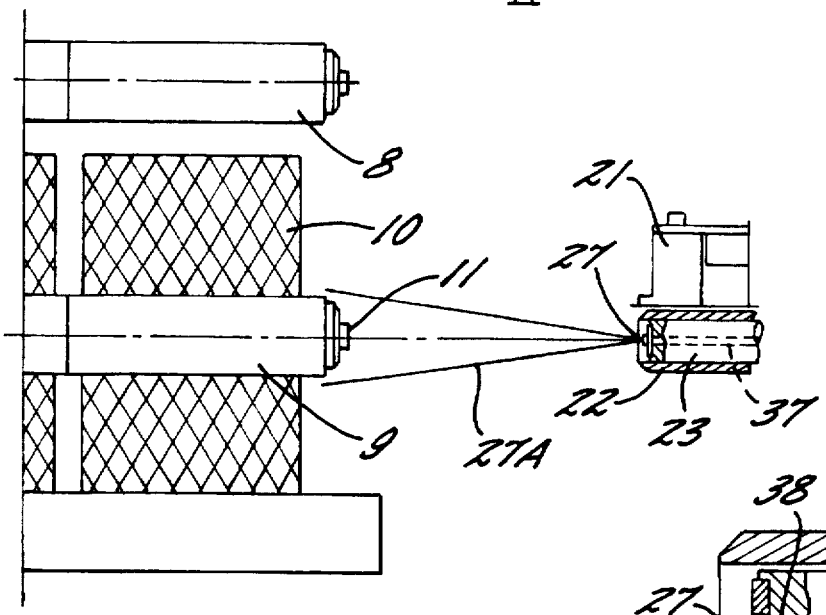
Figure 2A:
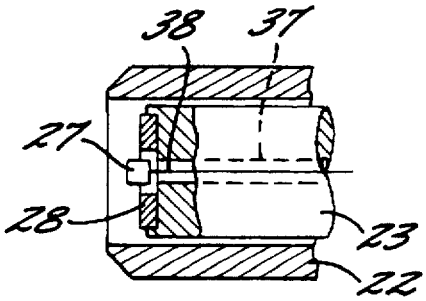
FIG. 2A is an enlarged detail view of FIG. 2.

A preferred embodiment is shown in FIGS. 1–2A. In this embodiment, the front ends of both winding spindles 6, 7 are provided each—for example in a circular recess arranged in their center—with a reflector 11, whereas the associated sensor arrangement comprises a light source 27 directed to the end of the idle spindle 7 that is to be doffed, and a suitable circuit 28 for evaluating the reflected light. Preferably, the reflector is made similar to a cat's eye, so that besides a main beam, the intensity of which decreases rapidly at a distance from the spindle axis, also a scattering cone with a reduced light intensity is reflected. When the package mandrel 22 is made tubular and a mandrel insert 23 is arranged therein in accordance with FIG. 2A, the control signals that are generated in circuit 28 as a function of the intensity of the reflected light, can be supplied to a doffer control unit not shown, via a signal line 38 arranged in an axial bore 37 in mandrel insert 23. This axial bore 37 may also be used for the supply of energy, if need be.

Figure 3A:
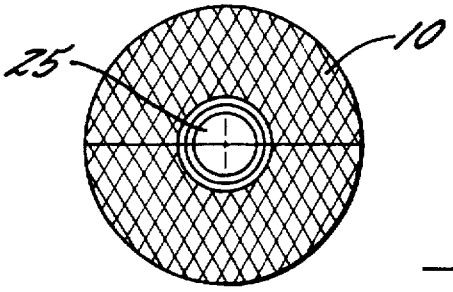
FIGS. 3A–3B are a front and a side view of a further embodiment of the invention operating on a mechanical basis.
Figure 3B:
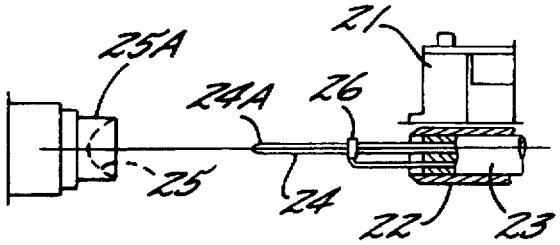

A mechanically operating embodiment of the tracking device is shown in FIGS. 3A and 3B. In this embodiment, the sensor arrangement is a position pin 24 with a sensor head 24A that is directed toward winding spindle 7. This position pin 24 may be flexible in itself or/and be anchored in package mandrel 22 or mandrel insert 23 for lateral deflection under the action of a force. The associated reflector arrangement is an extension 25A with a circular-cylindrical outer jacket, which covers substantially the free front surface of idle spindle 7. From the free front surface of extension 25A a recess serving as a sensor surface 25 extends, which is arranged concentric with the cylindrical outer jacket and has the shape of a preferably spherical segment or of a paraboloid, which is rotationally symmetric to the spindle axis. To make the package mandrel 22 follow, the position pin 24 can be moved toward the idle spindle 7, until it comes into contact with the sensor surface 25. For example, a detector 26 engaging the free length of position pin 24, or pressure sensors not shown, which may be arranged around the anchoring of position pin 24, package mandrel 22, or mandrel insert 23, may be used to convert radial deflections of the position pin, which are caused by its off-center contact with sensor surface 25, into control signals for the doffer control.

Figure 4A:
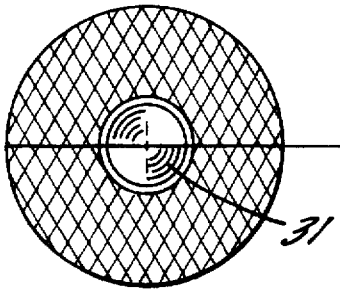
FIGS. 4A–4B illustrate a embodiment based on the principle of distance measurement by means of a laser beam.
Figure 4B:
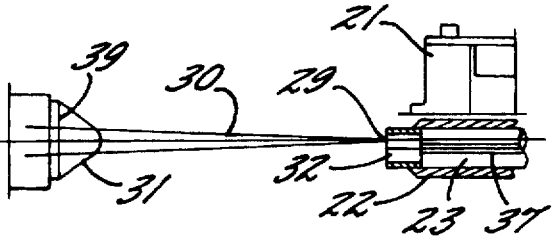

A further preferred embodiment of the tracking device in accordance with the invention is shown in FIGS. 4A and 4B. In this embodiment, the sensor arrangement is a source of laser 29, which is combined with a distance measuring device 32 and directed toward the front end of idle spindle 7. The reflector arrangement is a straight cone 31 with a circular base surface 39 having a diameter slightly smaller than the diameter of the winding spindle. The apex of the cone is preferably rounded. After aligning the package mandrel 22, so that the laser beam extending parallel to the spindle axis covers the cone 31, the position of package mandrel 22 is controlled in the sense of minimizing the distance by corresponding signals, which are supplied by distance measuring device 32 to the doffer control unit. As a result thereof, the accuracy of the follow-up operation can be influenced by the ratio of slenderness of the cone 31.

Deviating from the embodiment shown in the drawing, the reflector arrangement 31 may also be a recess which is provided on the front end of the winding spindle, rotationally symmetric to the spindle axis, in the form of a hollow cone, a paraboloid, or a spherical segment, and extends from a circular base surface with a diameter slightly below the diameter of the winding spindle. It is understood that in this arrangement the signals supplied to the doffer control unit must be effective in the sense of maximizing the distance.

Irrespective of the aforesaid selected embodiment, a preferred height of this reflector arrangement is substantially between 0.6 and 1.2 times of its base surface diameter.

Figure 5A:
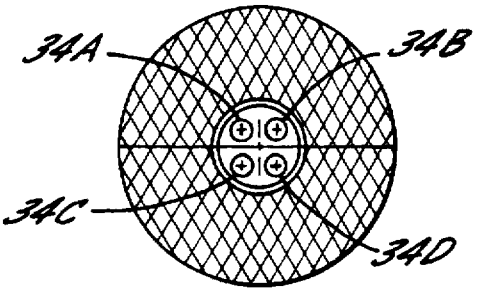
FIGS. 5A–5B illustrate an embodiment with an electromagnet as a sensor arrangement and coils as a reflector, each coil being short-circuited in itself and arranged symmetrically to the axis of the winding spindle.
Figure 5B:
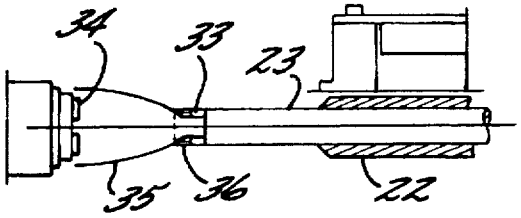
Figure 6A:
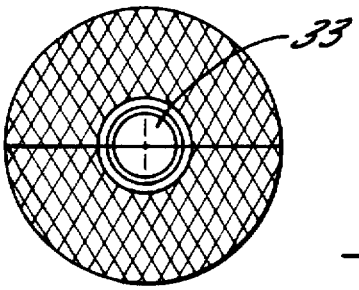
FIGS. 6A–6B illustrate the same embodiment as FIG. 5, but with the reflector coils arranged on the mandrel axis.
Figure 6B:
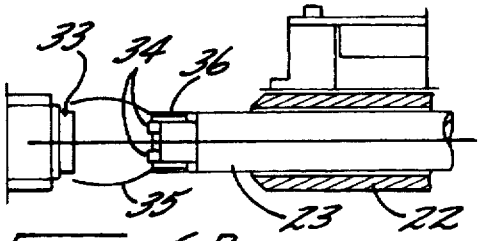

A further embodiment of the invention is shown in FIGS. 5A and 5B, as well as 6A, 6B, and 6C. In this embodiment, the sensor arrangement is an electromagnet 33 which is energized by an alternating current with selectable frequency. This electromagnet 33 is installed either on the head of package mandrel 22 or mandrel insert 23, or preferably—as shown in FIGS. 6A–B—on the head of winding spindle 6, 7. Between the package mandrel 22 or mandrel insert 23 and the front end of opposite winding spindle 7, the magnet builds up a magnetic field 35 that alternates periodically in direction. The frequencies for energizing the electromagnet 33 may be in a range, preferably from 10 Hz to 120 Hz, and in particular from 25 Hz to 90 Hz. The reflector arrangement of this embodiment consists of several wire coils 34A—34D which are short-circuited in themselves. They are arranged on the front end of respectively the package mandrel 22 or winding spindle 7, facing the electromagnet 33—namely, the winding spindle in FIGS. 5A—B, and the packages mandrel 22 in FIGS. 6A–B—and they extend symmetrically to the axis thereof. The number of the wire coils may vary within a relatively wide range, and be set, for example, to at least two, better three and six to eight coils. It has been found suitable, as shown, to arrange four wire coils 34A–34D symmetrically in two overlying rows, the spacings between the rows and the coils within the rows being the same. Deformations of the magnetic field which may be caused, namely in the absence of an alignment of opposite ends of winding spindle and package mandrel, by the actions of different a.c. voltages that are thereby generated in the coils, are detected and evaluated in both embodiments by a device 36, and supplied to the doffer control unit as control pulses for a follow-up movement, for example, in the manner described further above.

Figure 6C:
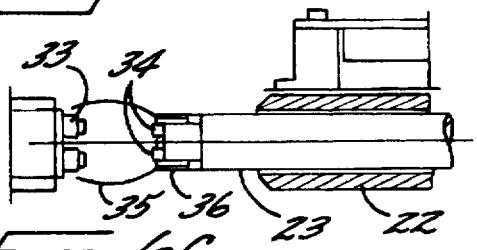
FIG. 6C illustrates an embodiment similar to FIGS. 5 and 6, but with four electromagnets.

In each of the two embodiments, the magnetic field 35 is built up by one magnet. However, as shown in FIG. 6C, it is also possible to provide, for example four magnets 33, which are arranged parallel to one another and strictly symmetrically to the axis of the spindle or package mandrel, and which build up identical magnetic fields. These magnets are preferably bar magnets 33, which may also be arranged either on the head of package mandrel 22 or mandrel insert 23 or on the head of winding spindle 6; 7.

The respective evaluation circuit of the detector generates control signals, from which the relative position of the idle spindle 7 and package mandrel 22 of doffer 21 is calculated. The doffer control activates the linear drives for the vertical and lateral movements of the package mandrel 22, until the idle spindle 7 and package mandrel 22 are aligned with one another, so that, on the one hand, the full packages 10 can be removed and, on the other hand, the empty tubes 8, 9, which are on standby on a second mandrel extending parallel to the package mandrel can be slipped onto the emptied idle spindle. This occurs in a second stopping position of spindle revolver 5, which is determined by the evaluation unit of the doffer or by the machine control unit. In this instance, the revolver 5 is not moved on for the duration of the servicing operation, and the rotational drive 19 is temporarily stopped.

Figure 7:
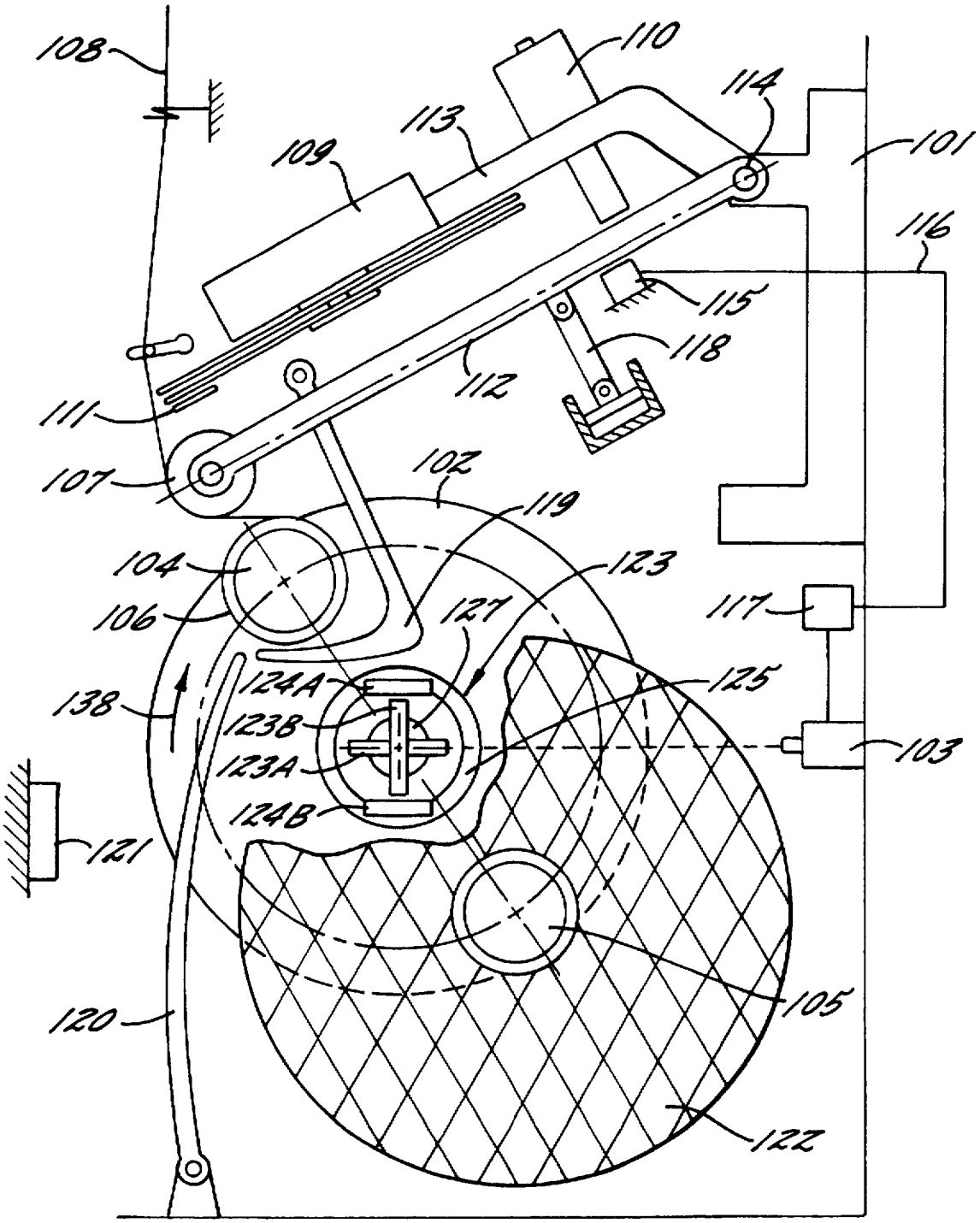
FIG. 7 is a schematic front view of a takeup machine equipped with a magnetic field sensor.

FIG. 7 is a schematic front view, similar to that described with reference to FIG. 1, illustrating a takeup machine of the present invention for a continuously advancing yarn 108. This takeup machine has a spindle revolver 102 and corresponds in its construction, with respect to essential components, to the takeup machine as described in the initially mentioned publication WO 93/17949. The illustrated revolver position corresponds to the previously described position of operating spindle 104, hereafter referred to as zero position. This position is reached, when the operating spindle is rotated to its winding position at the beginning of a winding cycle. In this position of the revolver, a sensor roll 107 mounted on a rocker arm 112, and likewise a yarn traversing mechanism 109 which is mounted on a rocker arm 113 and actuated by a drive 110, are still raised by a pivot drive 118. The sensor roll does not yet contact a winding tube 106, and a pivot lever 119 mounting a sheet metal element which is not identified in more detail and serves to thread the yarn and separate the new tube 106 from a full package 122, is still in its operating position. In general, directly after starting a new winding cycle, the pivot lever 119 is raised, and the yarn traversing mechanism 109 as well as sensor roll 107 (FIG. 9) are lowered, the latter coming into contact with the package 122 that is in the process of being formed. In connection with the foregoing description, and with respect to further details concerning the yarn changing operation, the description of EP 374 536 B is herewith incorporated by reference.

Figures 8A, 8B:
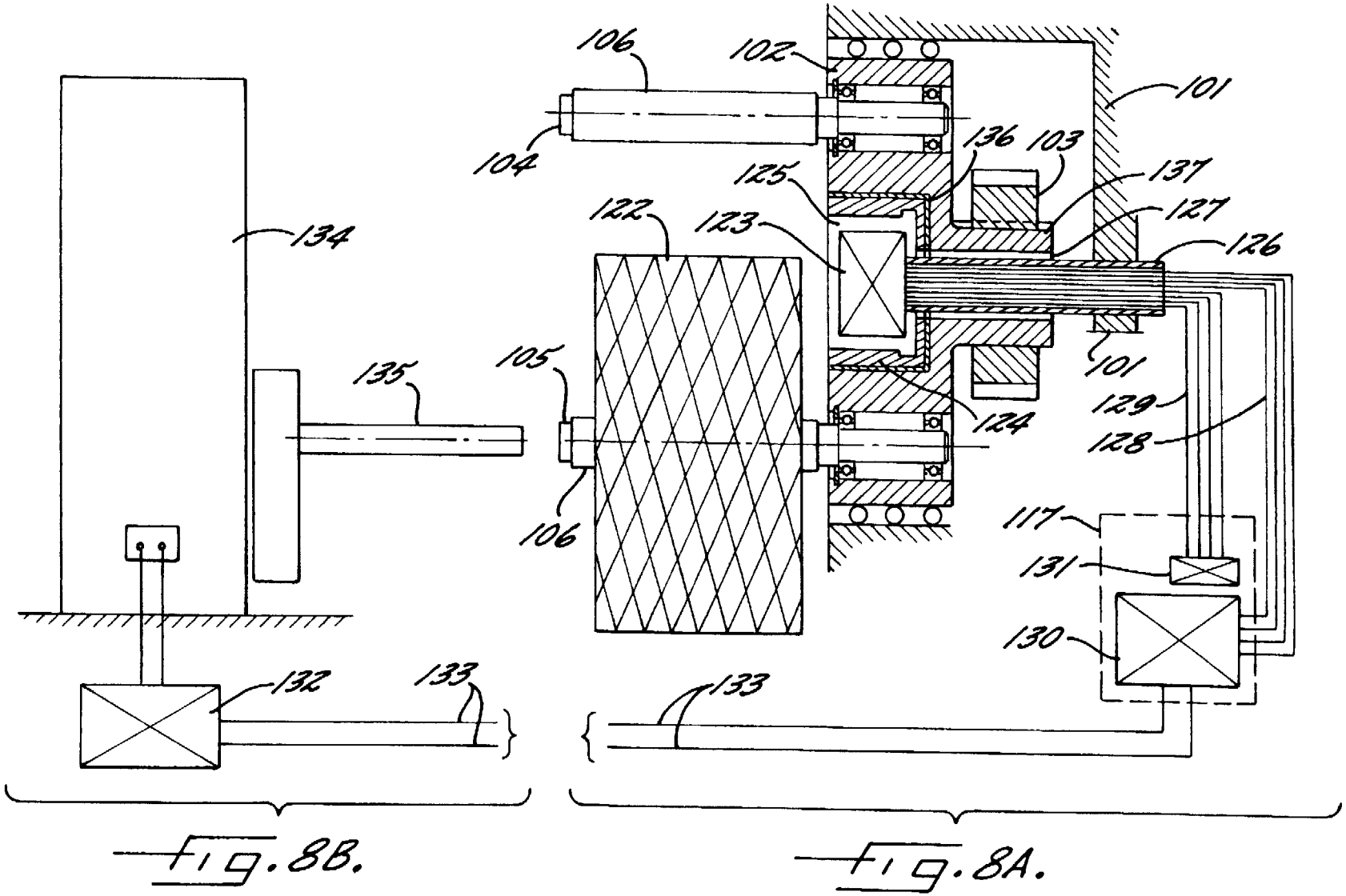
FIG. 8A is a side view of the takeup machine of FIG. 7.
FIG. 8B is a side view of the takeup machine with a doffer positioned in front of same.

It should be noted at this point, in particular with reference to FIGS. 8A and 8B, that in a takeup machine being equipped with a sensor roll 107, the winding spindles 104, 105, other than shown in FIG. 8A, are normally equipped with a direct drive. However, the invention can be used in like manner in takeup machines, in which the sensor roll 107 is replaced with a drive roll 107, and the operating spindle 104 is driven on its circumference by the drive roll 107.

Supported in spindle revolver 102 with a rotational drive 103 are two winding spindles 104, 105, which are brought by the rotation of spindle revolver 102 to a winding range and a doffing range. During the winding cycle, the spindle revolver 102 is rotated step by step, preferably substantially continuously, by rotational drive 103, which is controlled, as described, via sensor roll 107, in the direction of rotation 138. In this process, the sensor roll 107 which lies against the package surface during the winding operation and follows the increasing package diameter, is pivoted upward about an axis of rotation 114, until a preadjusted limit value between rocker arm 112 and a measuring device 115 is reached. A corresponding signal of the measuring device 115, which is connected via a signal line 116 to a control unit 117, causes the revolver drive 103 to start up, and the spindle revolver 102 is further rotated by a short length. This occurs in a constant succession in accordance with the increasing diameter of package 122 during the winding operation, until the package 122 has reached its final diameter. The sensor roll 107 is then raised again, and the spindle revolver 102 is operated, until a new empty tube 106 has moved to the zero position shown in FIG. 7, and the full package 122 is ready for being doffed. Thereafter, the package doff is initiated, as soon as a servicing automat (doffer) 134 associated to the machine is available (note FIG. 8).

As aforesaid, before a package doff can be started, it is necessary to align the doffer 134 with the takeup machine, so that its mandrel 135 for receiving full packages 122 is in exact alignment with the idle spindle 105 carrying package 122. Furthermore, it is necessary that package mandrel 135 and the device for inserting empty tubes 106, which is not shown, follow the idle spindle 105, which moves on, when the spindle revolver 102 continues to rotate after a first stopping position and removal of the full package or packages.

To this end, it is provided by the present invention, as shown in FIG. 7, that a sensor arrangement 123, in particular an arrangement of magnetic field sensors, detects constantly the continuously changing position of at least the idle spindle 105. This position is kept ready in the machine control unit for guiding the package mandrel 135 of a doffer 134.

In FIG. 7, in which a portion of full package 122 is cut out for making visible the sensor arrangement 123, and in the embodiment of the invention shown in FIG. 8A, the spindle revolver 102 accommodates a circular-cylindrical, cup-shaped recess 125 for receiving this sensor arrangement 123. This recess is concentric with the revolver axis, and extends from the front surface of the spindle revolver that mounts winding spindles 104, 105. Furthermore, a rotor shaft 137 contains an axial bore 127. Inserted into recess 125 are magnetic field sensors 123, 124. The magnet 124, a horseshoe-shaped permanent magnet, is fixedly connected inside recess 125 to the package revolver 102, so that it follows the rotational movements thereof and rotates along therewith.

Its poles 124A, 124B are aligned in axial direction and extend parallel to the cup wall. Indicated in FIG. 8A is a separating layer 136 that hold—depending on the material of the revolver—the magnet poles spaced apart from the cup wall, if need be, or separated from pot magnets used in similar fashion as the cup wall by a suitable separating layer 136.

The sensor arrangement 123 provided in the field of magnet 124 comprises at least one sensor element 123A. The sensor arrangement should not rotate along with the spindle revolver and must therefore be secured against rotation. To this end, the illustrated embodiment provides for a tubular carrier 126 which extends through rotor bore 127 and mounts at its front end the sensor arrangement 123. The rear end of carrier 126 is secured against rotation and joined directly or indirectly to machine frame 101.

For their operation, it is necessarthe sbias the sensor element or elements 123A, 123B with a d.c. voltage. Furthermore, it is necessary to provide for possibilities of tapping and evaluating the sensor voltage (Hall voltage). Therefore, in accordance with the invention, the sensor or each sensor 123A, 123B is connected, via signal lines 128 and supply lines 129 to an evaluation unit 117. Same is again connected, via control lines 133, to a control unit 132 of doffer 134 (note FIG. 8B).

As previously indicated, the magnetic field sensor 123, 124 may be differently aligned with winding spindles 104, 105. Thus, as shown in FIG. 7, the sensor 123, 124 may, for example, be installed such that the magnetic field lines of magnet 124 which rotates along with spindle revolver 102, extend vertically into the space, when the spindle revolver 102 is in the above-described zero position. Accordingly, the sensor element or one of sensor elements 123A, 123B is anchored with its axial extension transverse to the field lines, to machine frame 101, and it is secured against rotation, so that its lateral surfaces directed toward the magnet poles 124A, 124B intersect the field lines at an angle of 90°, when the axes of rotation of the two winding spindles 104, 105 overlie one another, as shown in FIG. 7.

Figure 9:
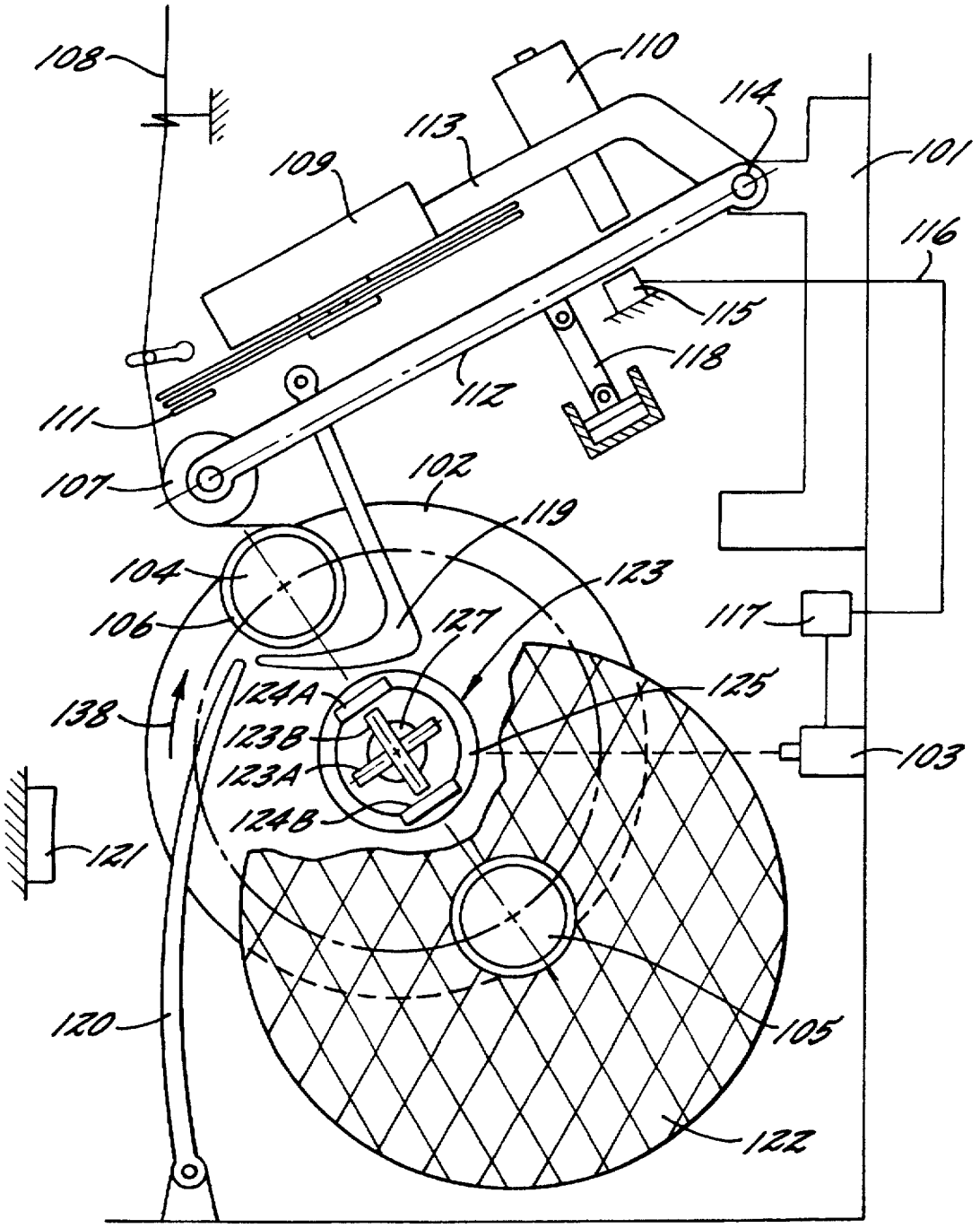
FIG. 9 is a schematic view similar to FIG. 7, but with a differently aligned magnetic field sensor.

In particular, when the sensor arrangement 123 comprises only one sensor element 123A, the arrangement shown in FIG. 9 is preferred. In this arrangement, the magnetic field lines extend, in each position of the spindle revolver 102, parallel to a plane drawn through the axes of the two winding spindles. Accordingly, the sensor element 123A is anchored to machine frame 101, with its axial extension being transverse to the field lines, and secured against rotation, so that in the zero position of spindle revolver 102, its lateral surfaces being directed to the magnet poles 124A, 124B, which are rotated into the plane extending through the winding spindle axes, intersect the field lines at an angle of 90°.

In particular, when the positions of the winding spindles 104, 105 are to be followed over 360°, it is preferred, in accordance with the invention, to provide two sensor elements 123A, 123B, of which the one sensor element 123A is secured in the aforesaid manner, and the other sensor element 123B, is rotated relative to the first sensor element 123A by an angle of 90°, the rotor or revolver axis being the axis of rotation.

It has shown that, subject to the further above-described parameters, an operation is preferred, which permits a continuous operation of the drive of spindle revolver 102 during the package doff. On the other hand, for example, when winding very fine deniers and/or at less high winding speeds, the switch cycles of rotational drive 103 for spindle revolver 102 may be further apart in time, since the package is built up slower. With an exact positioning of the doffer 134, as is enabled by the present invention, at the beginning of the package doff, and, if need be, with the inclusion of the switching pulses in the control of the package doff, the time intervals between the step-by-step movements will leave enough space for the package doff with a stopped spindle revolver drive 103.

While the foregoing description has dealt with a magnetic field sensor and its construction and arrangement in the spindle revolver 102 for use as sensor arrangement 123 in the detection of the angular position of the idle spindle, the invention is not limited to this particular realization of the measuring device. Instead, other measuring devices may be used, which permit to detect constantly and make available, in analog or digital form, the chronological changes in the angular position of the particular idle spindle 105 or both winding spindles 104, 105. For example, other known devices for determining the angle of rotation or measuring devices may be used, which evaluate the switch pulses of the stepping motor for the rotational drive 103 of spindle revolver 102.

We claim:

1. A method for continuously winding an advancing yarn onto bobbin tubes, and comprising the steps of providing a revolver which is rotatable about a central axis and which rotatably mounts two spindles which are rotatable about respective axes which are parallel to said central axis and with the two spindles being equally spaced about the periphery of the revolver, rotating the revolver so as to alternately move the spindles between an angular winding range and an angular doffing range and including (a) winding the advancing yarn onto a rotating bobbin tube which is positioned coaxially upon one of the spindles positioned in the winding range, while rotating the revolver about said central axis so that the one spindle moves through the winding range during which a full yarn package is formed on the bobbin tube, (b) donning an empty bobbin tube coaxially upon the other of said two spindles while the other spindle is within the doffing range, then (c) rotating the revolver so that the one spindle and the full package move to said doffing range and the other spindle and the donned empty bobbin tube move to said winding range, (d) transferring the advancing yarn from the full package to the donned empty bobbin tube which is positioned at the winding range, and (e) doffing the full package from said one spindle while the one spindle is in said doffing range, and including positioning a package receiving mandrel in general axial alignment with the one spindle, monitoring the position of the one spindle to detect any change of position thereof resulting from the continued rotation of the revolver, moving the package receiving mandrel so as to follow any detected movement of the one spindle and maintain the axial alignment of the one spindle and the package receiving mandrel, and axially displacing the full package from the one spindle onto the package receiving mandrel, and (f) cyclically repeating steps (a) through (e).

2. The method as defined in claim 1 wherein step (b) includes positioning a bobbin supporting device so as to support an empty bobbin tube in general axial alignment with the other spindle, monitoring the position of the other spindle to detect any change of position thereof, moving the bobbin supporting device so as to follow any detected movement of the other spindle and maintain the axial alignment of the other spindle and the empty bobbin tube, and axially displacing the empty bobbin tube from the bobbin supporting device onto the other spindle.

3. The method as defined in claim 1 wherein step (a) includes traversing the yarn at a location upstream of the winding range to form a cross wound package on the bobbin tube, engaging the surface of the package being formed with a contact roll, with the contact roll being mounted for limited movement in a radial direction away from the one spindle as the package builds, and sensing the movement of the contact roll and rotating the revolver so as to laterally move the package being formed along the winding range and thereby increase the radial distance between the one spindle and the contact roll, and so as to maintain the positioning of the contact roll within a predetermined narrow range of movement during the course of the winding operation.

4. The method as defined in claim 3 wherein the step of monitoring the position of the one spindle under step (e) includes sensing the movement of the contact roll, and the step of moving the package receiving mandrel so as to follow any detected movement of the one spindle under step (e) includes moving the package receiving mandrel in response to a sensed movement of the contact roll.

5. The method as defined in claim 3 wherein the step of monitoring the position of the one spindle under step (e) includes sensing the movement of the one spindle via a sensor associated with the package receiving mandrel, and the step of moving the package receiving mandrel so as to follow any detected movement of the one spindle under step (e) includes moving the package receiving mandrel in response to an output signal generated by said sensor.

6. The method as defined in claim 1 wherein the angular doffing range begins 180° from the beginning of the angular winding range.

7. The method as defined in claim 6 wherein the angular doffing range extends for between about 15° and 75°.

8. The method as defined in claim 1 wherein the step of monitoring the position of the one spindle to detect any change of position thereof is conducted continuously.

9. The method as defined in claim 1 wherein step (e) is conducted without influence upon the step of rotating the revolver under step (a).

10. An apparatus for continuously winding an advancing yarn onto bobbin tubes comprising a revolver which is rotatable about a central axis and which rotatably mounts two spindles which are rotatable about respective axes which are parallel to the central axis and with the two spindles being equally spaced about the periphery of the revolver, a drive for rotating the revolver so as to alternately move the spindles between an angular winding range and an angular doffing range, means for winding the advancing yarn onto a rotating bobbin tube which is positioned coaxially upon one of the spindles positioned in the winding range, while causing said drive to rotate the revolver about the central axis so that the one spindle moves through the winding range during which a full yarn package is formed on the bobbin tube, means for doffing a full package while the one spindle is in the doffing range, and comprising a doffing carriage mounted for movement to a position adjacent said revolver, said doffing carriage including at least one package receiving mandrel, and a control system for, upon a full package being formed on said one spindle in said winding range, 1) rotating the revolver so that the one spindle and the full package move from said winding range to said doffing range, 2) positioning the doffing carriage adjacent said revolver and so that the package receiving mandrel is generally coaxially aligned with said one spindle, 3) monitoring the position of the one spindle to detect any change of position thereof, 4) moving the package receiving mandrel so as to follow any detected movement of the one spindle and maintain the axial alignment of the one spindle and the package receiving mandrel, and 5) axially displacing the full package from the one spindle onto the package receiving mandrel.

11. The apparatus as defined in claim 10 wherein said control system includes a tracking device for monitoring the position of the one spindle and which comprises a sensor device positioned on one of the one spindle and the package receiving mandrel, and a reflector positioned on the other of the one spindle and the package receiving mandrel.

12. The apparatus as defined in claim 11 wherein said sensor device is positioned on the free end of the package receiving mandrel and a reflector is positioned on the free end of each of said two spindles.

13. The apparatus as defined in claim 12 wherein said package receiving mandrel comprises a supporting tube, and a mandrel insert mounted for axial displacement in said tube, and wherein said mandrel insert mounts said sensor device.

14. The apparatus as defined in claim 13 wherein said sensor device includes a signal line extending through said mandrel insert and to a control unit of said doffing carriage.

15. The apparatus as defined in claim 12 wherein said sensor device comprises a flexible position pin which is mounted for axial movement on the package receiving mandrel and which terminates in a sensor head at the free end, and wherein the reflector on each of said spindles includes a concave recess for receiving the sensor head of the position pin.

16. The apparatus as defined in claim 12 wherein said sensor device comprises a light source for emitting a beam of light toward the one spindle, and wherein the reflector on each of said spindles acts to reflect the light beam back toward the package receiving mandrel.

17. The apparatus as defined in claim 16 wherein the light source emits a beam of laser light.

18. The apparatus as defined in claim 11 wherein said sensor device comprises an electromagnet, and the reflector comprises at least one wire coil, and wherein said control system further includes a device for detecting and evaluating a voltage induced in said wire coil by said electromagnet.

19. The apparatus as defined in claim 10 wherein said control system includes a tracking device for monitoring the position of the one spindle and which comprises at least one magnet and at least one magnetic field sensor, with one of the magnet and magnetic field sensor being fixedly connected to the revolver so as to rotate therewith, and the other of the magnet and magnetic filed sensor being fixedly mounted so as to not rotate with the revolver.

20. The apparatus as defined in claim 19 wherein said magnet and said magnetic field sensor are mounted in a cup shaped recess which is coaxially aligned with the rotational axis of said revolver.

21. The apparatus as defined in claim 20 wherein said revolver includes a bore extending coaxially through said revolver, wherein a tubular carrier is mounted coaxially in said bore, with the tubular carrier being anchored so as to not rotate with said revolver, and wherein one of the magnet and the magnetic field sensor is mounted to the revolver and the other of the magnet and the magnetic field sensor is mounted to the tubular carrier.

* * * * *